United States Patent [19]

Sutula et al.

[11] Patent Number: 4,960,564

[45] Date of Patent: Oct. 2, 1990

[54] PYROPHORIC ALLOY COMPLEXES

[75] Inventors: Raymond A. Sutula, Laurel; Frederick E. Wang, Silver Spring, both of Md.

[73] Assignee: The United States of America as represented by the Secretary of the Navy, Washington, D.C.

[21] Appl. No.: 899,058

[22] Filed: Apr. 6, 1978

[51] Int. Cl.[5] ..... C06B 43/00

[52] U.S. Cl. ..... 420/400; 149/22; 149/108.2

[58] Field of Search ..... 149/22; 75/134 P, 134 A; 420/400

[56] References Cited

U.S. PATENT DOCUMENTS

| | | | |
|---|---|---|---|
| 3,629,916 | 12/1971 | Vollmer | 75/134 A |
| 4,110,111 | 8/1978 | Wang | 75/134 A |
| 4,162,352 | 7/1979 | Sutula et al. | 429/29 |
| 4,512,960 | 4/1985 | Szware | 423/219 |

*Primary Examiner*—Brooks H. Hunt
*Assistant Examiner*—Leon Nigohosian, Jr.
*Attorney, Agent, or Firm*—Kenneth E. Walden; Roger D. Johnson

[57] ABSTRACT

Alloy complexes which are composed of (1) lithium (Li) (2) Boron (B), and (3) one or more of the following elements: sodium (Na), potassium (K), rubidium (Rb), and cesium (Ce). These alloy complexes in powder form react spontaneously with air upon contact to produce large amounts of heat.

10 Claims, No Drawings

PYROPHORIC ALLOY COMPLEXES

BACKGROUND OF THE INVENTION

This invention generally relates to metal alloys and more particularly to lithium-boron-alkali metal alloys.

The phase diagrams for the binary systems of boron-sodium, boron-potassium, boron-rubidium, and boron-cesium have not been characterized. With regard to the boron-sodium system, H. Moisson [Comptes Rendus, 114, 319 (1892)] reported that boron does not dissolve in boiling sodium. Of the binary systems of lithium-sodium, lithium-potassium, lithium-rubidim, and lithium-cesium, B. Böhm and W. Klemm [Anorg. Chem. 243. 69–85 (1939)] reported that lithium does not alloy with either potassium or rubidium. According to T. R. Cuerou and F. Tepper [Am. Rocket Soc., Preprint No. 2537–62 (5 pp), 1962], cesium is slightly soluble in molten lithium at high temperatures. For instance, at 760° C. the solubility of cesium in lithium (in two runs) was 0.007 and 0.018 atomic percent cesium, and at 1093° C., the solubility of cesium in lithium (in two runs) was 0.336 and 0.704 atomic percent cesium. Further, the phase diagrams of the lithium-sodium system, reinvestigated by W. H. Howland and L. F. Epstein [Advan. Chem. Ser., 19, 34–41 (1957)], shows a large immiscibility region below 442 ±10° C.; above 442±10° C. sodium is miscible in lithium.

True lithium-boron metal alloys were prepared by F. E. Wang [U.S. Pat. No. 4,110,111, entitled "Metal alloy and Method of Preparation Thereof," which issued to Frederick E. Wang on Aug. 29, 1978 that patent is a continuation-in-part of U.S. Patent application Ser. No. 377,671, filed on July 5, 1973, now abandoned]. Moreover, true lithium-boron-magnesium metal alloys were prepared by the present inventors, F. E. Wang and R. A. Sutula, [U.S. Patent application, Ser. No. 575,543, filed on May 5, 1975]. However, alloy systems of lithium-born-M wherein M is selected from the group consisting of sodium, potassium, rubidium, cesium, or mixtures thereof have not previously been investigated.

SUMMARY OF THE INVENTION

Accordingly one object of this invention is to provide novel alloys.

Another object of this invention is to provide methods of making these novel alloys.

A further object of this invention is to provide new pyrotechnic materials.

These and other objects of this invention are accomplished by providing an alloy of the formula $Li_xB_yM_z$ wherein x is the atomic fraction of lithium, y is the atomic fraction of boron, and z is the atomic fraction of M which is an alkali metal selected from the group consisting of sodium, potassium, rubidium, cesium, and mixtures thereof. When M is sodium, $0.1\ 0 \leqq x \leqq 0.40$, $0.55 \leqq y \leqq 0.70$, and $0.05 \leqq z \leqq 0.20$. When M is potassium, $0.10 \leqq x \leqq 0.35$, $0.60 \leqq y \leqq 0.70$, and $0.05 \leqq z \leqq 0.20$. When M is rubidium, $0.15 \leqq x \leqq 0.45$, $0.50 \leqq y \leqq 0.60$, and $0.05 \leqq z \leqq 0.25$. When M is cesium, $0.10 \leqq x \leqq 0.44$, $0.55 \leqq y \leqq 0.65$, and $0.01 \leqq z \leqq 0.25$. When M is a mixture of two or more of these alkali metals, $0.10 \leqq x \leqq 0.40$, $0.55 \leqq y \leqq 0.65$, and $0.05 \leqq z \leqq 0.25$. In each of these cases, $x+y+z=1$.

The alloy of the formula $Li_xB_yM_z$, wherein x, y, z, and M are as defined above, is prepared by (1) melting and mixing together the lithium and the alkali metal, M, which is selected from the group consisting of sodium, potassium, rubidium, cesium, and mixtures thereof at a temperature in the range of from about 250° C. to about 550° C.

(2) dissolving boron into the molten lithium-alkali metal mixture at a temperature in the range of from about 400° C. to about 600° C.; and (3) heating the resulting molten lithium-boron-alkali metal solution in the temperature range of from 600° C. to 750° C. until the solution solidifies. With good mechanical stirring, the alloy solidifies from liquid to solid as a fine powder. In the absence of mechanical stirring, the alloy solidifies to bulk mass.

The alloys of the present invention may be used as pyrotechnic materials or as metal fuels in rockets.

DETAILED DESCRIPTION OF THE PREFERRED EMBODIMENT

The metal alloys of this invention have the formula $Li_xB_yM_z$ wherein M is an alkali metal selected from the group consisting of sodium, potassium, rubidium, cesium, and mixtures thereof, and wherein x is the atomic fraction of lithium, y is the atomic fraction of boron, and z is the atomic fraction of the alkali metal or alkali metals represented by M. The sum of x, y, and z equals one. Broad, preferred, and more preferred ranges for the atomic fraction of each of the elements of the alloy are given in Table 1:

TABLE I

| M | | BROAD RANGES (Atomic Fractions) | | PREFERRED RANGES (Atomic Fractions) | |
|---|---|---|---|---|---|
| (1) Sodium | (a) | $0.10 \leqq x \leqq 0.40$ | (d) | $0.10 \leqq x \leqq 0.21$ | |
| | (b) | $0.55 \leqq y \leqq 0.70$ | (e) | $0.62 \leqq y \leqq 0.70$ | |
| | (c) | $0.05 \leqq z \leqq 0.20$ | (f) | $0.17 \leqq z \leqq 0.20$ | |
| (2) Potassium | (a) | $0.10 \leqq x \leqq 0.35$ | (d) | $0.21 \leqq x \leqq 0.27$ | |
| | (b) | $0.60 \leqq y \leqq 0.70$ | (e) | $0.61 \leqq y \leqq 0.63$ | |
| | (c) | $0.05 \leqq z \leqq 0.20$ | (f) | $0.12 \leqq z \leqq 0.16$ | |
| (3) Rubidium | (a) | $0.15 \leqq x \leqq 0.45$ | (d) | $0.19 \leqq x \leqq 0.20$ | |
| | (b) | $0.50 \leqq y \leqq 0.60$ | (e) | $0.57 \leqq y \leqq 0.60$ | |
| | (c) | $0.05 \leqq z \leqq 0.25$ | (f) | $0.20 \leqq z \leqq 0.24$ | |
| (4) Cesium | (a) | $0.10 \leqq x \leqq 0.44$ | (d) | $0.23 \leqq x \leqq 0.33$ | |
| | (b) | $0.55 \leqq y \leqq 0.65$ | (e) | $0.61 \leqq y \leqq 0.65$ | |
| | (c) | $0.01 \leqq z \leqq 0.25$ | (f) | $0.02 \leqq z \leqq 0.16$ | |
| (5) Mixture[1] | (a) | $0.10 \leqq x \leqq 0.40$ | (d) | $0.25 \leqq x \leqq 0.27$ | |
| | (b) | $0.55 \leqq y \leqq 0.65$ | (e) | $0.60 \leqq y \leqq 0.62$ | |
| | (c) | $0.05 \leqq z \leqq 0.25$ | (f) | $0.11 \leqq z \leqq 0.15$ | |

[1]A mixture of two or more alkali metals selected from the group consisting of sodium, potassium, rubidium, and cesium.

The alloys of the present invention are prepared by a three step process. First, lithium and an another alkali metal which may be sodium, potassium, rubidium, cesium, or mixtures thereof are melted and mixed together at a temperature of from about 250° C. to about 550° C. As pointed out in the background of the invention, these metals are insoluble in each other. Second, boron is added and dissolved into the molten lithium-alkali metal mixture at a temperature of from 400° C. to 600° C. All of the boron must be dissolved before the temperature is allowed to exceed 600° C. As the boron goes into solution, the lithium and the other alkali metal become miscible in each other and form a liquid solution. Third, the lithium-boron-other alkali liquid solution is heated slowly until it solidifies, generally in the range of between 600° C. and 750° C. The ternary liquid alloy solidifies to form a solid state alloy complex. This solid state complex can exist either as a finely divided powder or as a bulk mass. The formation of the finely divided powder form is accomplished by good mechanical stirring or agitation of the liquid alloy solution prior to and during its transformation from a liquid to a solid. Because molten lithium and molten sodium, potassium, rubidium, and cesium are very reactive, all of the steps of this process must be run in an inert environment such as a dry helium atmosphere. Moreover, the product lithium-boron-other alkali metal alloy should also be stored in an inert environment to prevent ignition or decomposition of the product.

An existing lithium-boron-other alkali metal powered alloy may be modified by the addition of one or more additional alkali metals. For instance, in Example 5 a lithium boron-potassium powdered alloy is modified to form a lithium-boron-potassium-cesium powdered alloy. The general procedure is to mix, at room temperature, the existing lithium-boron-other alkali metal powered alloy with the alkali metal to be added. The mixture is then slowly heated to about 500° C., where it is held for a few minutes. The powdered alloy product is then cooled to room temperature. Again, because of the extreme reactivity of the reactants and products, all of these steps are performed in an inert (e.g., dry helium) environment.

The lithium, sodium, potassium, rubidium, and cesium used to prepare the alloy may be of commercial grade.

Crystalline boron is preferred over amorphous boron because invariably amorphous boron has an oxide coating which prevents or at least retards the reaction between boron and lithium and the other alkali metals. As a result, the amorphous boron either fails to dissolve in the molten lithium-alkali metals solution or only dissolves with great difficulty. However, amorphous boron may be used in this invention if the boron oxide content in the amorphous boron is kept at less than 0.2 weight percent.

Because sodium, potassium, rubidium, and cesium have relatively high vapor pressures at about 600° C., some loss of these elements due to vaporization is inevitable in an open crucible, and the compositions of the final solid alloy complexes will not be exactly the same as the relative proportions of the starting materials. However, it has been confirmed that the variation in the atomic percentages of these metals caused by vaporization is not critical to formation of an alloy nor does it affect the workings of the alloy complexes as pyrotechnic materials. Nevertheless, it is advisable to use state of the art techniques——such as reflux columns or pressure vessels—to minimize the loss of these metals due to vaporization.

The addition of the alkali metals, sodium, potassium, rubidium, or cesium, to the lithium-boron system produces alloy complexes with the following unique properties which have never been observed in the individual binary systems (Li—B, Li—X or B—X where X is sodium, potassium, rubidium, or cesium) on which the ternary systems described in this invention disclosed are based: (a) These alloy complexes spontaneously ignite and continue to burn when exposed to air or oxygen. (b) The burning alloy complex can be quenched by denying air or oxygen to the material. (c) The powdered alloy complex can be compacted into pellets. When exposed to air, the surface will darken and react slowly. However, if air or oxygen is blown directly at the compressed pellet, the alloy complex will burn. (d) The temperature of combustion when the alloy complexes are burned can be controlled by varying the flow rate of oxygen or air coming into contact with the complex. For example, if a high flow rate of oxygen is used, the alloy complex will burn at a much faster rate and at a higher temperature.

The general nature of the invention having been set forth, the following examples are presented as specific illustrations thereof. It will be understood that the invention is not limited to these specific examples but is susceptible to various modifications that will be recognized by one of ordinary skill in the art.

EXAMPLE 1 lithium-boron-sodium

In an inert atmosphere (dry helium) glove box, 5.71 gm sodium (MSA Research Corp.) and 1.39 gm lithium (Foote Mineral Company) were placed in an iron crucible which was then placed in a furnace and heated to 550° C. To the molten metals at 550° C. was added the following amounts of crystalline boron (Atomergic Chemetal Co): 5.0, 4.0, 1.0, 1.0, 1.3, 0.7, and 1.0 gm. It was noted that with each addition of boron, the boron dissolved and the viscosity of the lithium-boron-sodium system increased. After the last amount of boron had been added, the furnace temperature was increased from 550° C. to about 750–800° C. Within the temperature range (700–750° C.) the viscous metallic material transformed into a gray powder. The powder was removed from the furnace, cooled to room temperature and removed from the glove box. It was found that this alloy complex, whose atomic composition was 11.5 percent lithium, 14.2 percent sodium, and 74.3 percent boron, ignited spontaneously and continued to burn when exposed to air.

Table II summaries the other compositions of the lithium-boron-sodium system which have been prepared. It was found that if the material was in bulk form (not finely divided) and exposed to atmospheric air, the surface would darken, react slowly and would not ignite spontaneously as it does in the fine powder case. However, if the material was finely divided and exposed to air, a spontaneous and continuous burning was observed.

TABLE II

Compositions[1] of Li—B—Na Investigated

| | ATOMIC PERCENTAGE | | | |
|---|---|---|---|---|
| ELEMENT | SAMPLE 1 | SAMPLE 2 | SAMPLE 3 | SAMPLE 4 |
| Lithium | 15.5 | 17.8 | 18.4 | 10.0 |
| Sodium | 19.2 | 19.7 | 17.1 | 20.0 |
| Boron | 65.3 | 62.5 | 64.5 | 70.0 |

EXAMPLE 2 lithium-boron-potassium

In an inert atmosphere (helium) glove box 3.880 gm potassium (MSA Research Corporation) and 0.945 gm lithium (Foote Mineral Company) were placed in a crucible which was then placed in a furnace and heated to 500° C. To the molten metals at 550° C. was added 4.466 gm of crystalline boron (Atomergic Chemetals Co). As the boron dissolved into the molten metals, a pasty, solid precipitate formed at the bottom of the crucible. The furnace temperature was increased from 550° C. to about 700° C. At about 650° C. the system underwent a phase transition from a solid-liquid mixture to an off-white homogeneous powder of the alloy complex. The powder was removed from the furnace, cooled to room temperature and removed from the glove box. It was found that this alloy complex, whose atomic composition was 21.0 percent lithium, 15.3 percent potassium, and 63.7 percent boron, ignited spontaneously and continued to burn when exposed to air. Another alloy complex, whose atomic composition was 25.7 percent lithium, 12.6 percent potassium, and 61.7 percent boron was prepared by the above methods and ignited spontaneously and continued to burn when exposed to air.

EXAMPLE 3

Lithium-boron-rubidium

In an inert atmosphere (helium) glove box 8.070 gm of crystalline boron (Atomergic Chemetals Co) and 27.210 gm rubidium (MSA Research Corporation) were placed in a crucible which was then placed in a furnace and heated to 300° C. Although the molten rubidium wetted the boron crystals, no reaction occurred between the boron and the rubidium. Between 300° and 610° C., 1.816 gm lithium (Foote Mineral Company) was added to the rubidium-boron mixture. At this point for the first time the boron began to dissolve into the liquid solution. As the boron dissolved, a pasty precipitate formed at the bottom of the crucible. The furnace temperature was increased to 750° C. Within the temperature range 610–750° C., it was noted that the pasty precipitate became more dense and that an exothermic reaction took place such that the crucible glowed red. During the exothermic reaction, the solid precipitate expanded in volume filling the crucible with an off-white powder. The powder was removed from the furnace, cooled to room temperature and removed from the glove box. It was found that this alloy complex, whose atomic composition[1] was 19.7 percent lithium, 24.0 percent rubidium, and 56.3 percent boron, ignited spontaneously and continued to burn when exposed to air.

EXAMPLE 4 lithium-boron-cesium

In an inert atmosphere (helium) glove box 11.253 gm cesium (MSA Research Corporation) and 9.495 gm of crystalline boron (Atomergic Chemetal Co.) were placed in a crucible which was then placed in a furnace and heated to 500° C. Although the cesium coated the boron, no observable reaction between the boron and cesium could be detected. At 500° C., 2.007 gm of lithium (Foote Mineral Company) were added to the boron-cesium mixture. When the lithium was added, an insoluble precipitate formed at the bottom of the crucible. The furnace temperature was increased to about 725° C. Within this temperature range (500–725° C.) a phase transition occurred in which the volume of the precipitate expanded to about 2.5 times its original volume. After this phase transition no liquid metal was visible. This powder was removed from the furnace, cooled to room temperature, and removed from the glove box. It was noted that this alloy complex, whose atomic composition[1] was 24.9 percent lithium, 7.3 percent cesium, and 67.8 percent boron ignited spontaneously and continued to burn when exposed to air. Table III summarizes the other compositions of the lithium-boroncesium system which were prepared and gave the same results as described above.

TABLE III

| | Compositions[1] of Li—B—Cs Investigated ATOMIC PERCENTAGE | | | | | | | |
|---|---|---|---|---|---|---|---|---|
| ELEMENT | SAMPLE 1 | SAMPLE 2 | SAMPLE 3 | SAMPLE 4 | SAMPLE 5 | SAMPLE 6 | SAMPLE 7 | SAMPLE 8 |
| Lithium | 20.5 | 20.5 | 21.0 | 31.6 | 30.8 | 32.5 | 30.8 | 30.9 |
| Cesium | 15.0 | 14.9 | 15.3 | 5.1 | 7.5 | 2.5 | 7.7 | 7.4 |
| Boron | 64.5 | 64.6 | 63.7 | 63.3 | 61.7 | 65.0 | 61.5 | 61.7 |

EXAMPLE 5

Lithium-boron-cesium-potassium

In an inert atmosphere (helium) glove box, 2.430 gm potassium (MSA Research Corporation) and 0.877 gm lithium (Foote Mineral Company) were placed in a crucible which was then placed in a furnace and heated to 500° C. To the molten metals at 550° C. was added 3.279 gm of crystalline boron (Atomergic Chemetals Co.). As the boron dissolved into the molten metals, a pasty, solid precipitate formed at the bottom of the crucible. The furnace temperature was increased from 550° C. to about 700° C. At about 650° C. the system underwent a phase transition from a solid-liquid mixture to an off-white homogeneous powder of the alloy complex. The powder was removed from the furnace and cooled to room temperature. To this material 0.760 gm cesium (MSA Research Corporation) was added and the resulting mixture heated to 500° C. for several minutes. The resulting off-white alloy complex was removed from the furnace, cooled to room temperature and removed from the glove box. It was found that this alloy complex, whose atomic composition[1] was 25.4 percent lithium, 12.5 percent potassium, 1.2 percent cesium and 60.9 percent boron, ignited spontaneously and continued to burn when exposed to air. Another sample, whose atomic composition[1] was 26.1 percent lithium, 10.5 percent potassium, 1.3 percent cesium, and 62.1 percent boron, was prepared according to the above method and was found to ignite spontaneously and continue to burn when exposed to air.

Footnote to all five of the Examples: [1]The atomic compositions indicated are those of the as prepared material. Since the alkali metals (sodium, potassium, rubidium, and cesium) have relatively high vapor pressures at about 600° C., some loss of these elements due to vaporization is inevitable, and the atomic compositions listed may not be exact. However, we have confirmed that the exact variation in the composition of these metals (sodium, potassium, rubidium, and cesium) caused by vaporization is not a critical parameter to this invention nor does it affect the working of the alloy complexes.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A alloy of the formula $Li_xB_yM_z$ wherein M is sodium, and wherein $0.10 \leqq x \leqq 0.40$, $0.55 \leqq y \leqq 0.70$, $0.05 \leqq z \leqq 0.20$, and $x+y+z=1$ wherein x is the atomic fraction of lithium, y is the atomic fraction of boron, and z is the atomic fraction of sodium.

2. The alloy of claim 1 wherein $0.10 \leqq x \leqq 0.21$, $0.62 \leqq y \leqq 0.70$, and $0.17 \leqq z \leqq 0.20$.

3. An alloy of the formula $Li_xB_yM_z$ wherein M is potassium, and wherein $0.10 \leqq x \leqq 0.35$, $0.60 \leqq y \leqq 0.70$, $0.05 \leqq z \leqq 0.20$, and $x+y+z=1$ wherein x is the atomic fraction of lithium, y is the atomic fraction of boron, and z is the atomic fraction of potassium.

4. The alloy of claim 3 wherein $0.21 \leqq x \leqq 0.27$, $0.61 \leqq y \leqq 0.63$, and $0.12 \leqq z \leqq 0.16$.

5. A alloy of the formula $Li_xB_yM_z$ wherein M is rubidium, and wherein $0.15 \leqq x \leqq 0.45$, $0.50 \leqq y \leqq 0.60$, $0.05 \leqq z \leqq 0.25$, and $x+y+z=1$ wherein x is the atomic fraction of lithium, y is the atomic fraction of boron, and z is the atomic fraction of rubidium.

6. The alloy of claim 5 wherein $0.19 \leqq x \leqq 0.20$, $0.57 \leqq y \leqq 0.60$, and $0.20 \leqq z \leqq 0.24$.

7. A alloy of the formula $Li_xB_yM_z$ wherein M is cesium, and wherein $0.10 \leqq x \leqq 0.44$, $0.55 \leqq y \leqq 0.65$, $0.01 \leqq z \leqq 0.25$, and $x+y+z=1$ wherein x is the atomic fraction of lithium, y is the atomic fraction of boron, and z is the atomic fraction of cesium.

8. The alloy of claim 7 wherein $0.25 \leqq x \leqq 0.33$, $0.61 \leqq y \leqq 0.65$, and $0.02 \leqq z \leqq 0.16$.

9. An alloy of the formula $Li_xB_yM_z$ wherein M is a mixture of two or more alkali metals selected from the group consisting of sodium, potassium, rubidium, and cesium, and wherein $0.10 \leqq x \leqq 0.40$, $0.55 \leqq y \leqq 0.65$, $0.05 \leqq z \leqq 0.25$, and $x+y+z=1$ wherein x is the atomic fraction of lithium, y is the atomic fraction of boron, and z is the sum of the atomic fractions of the alkali metals selected from the group consisting of sodium, potassium, rubidium, and cesium.

10. The alloy of claim 9 wherein $0.25 \leqq x \leqq 0.27$, $0.60 \leqq y \leqq 0.62$, and $0.11 \leqq z \leqq 0.15$.

* * * * *